US008482266B2

(12) United States Patent
Yu et al.

(10) Patent No.: US 8,482,266 B2
(45) Date of Patent: Jul. 9, 2013

(54) VOLTAGE REGULATION CIRCUITRY AND RELATED OPERATING METHODS

(75) Inventors: Chuanzhao Yu, Chandler, AZ (US); Luis J. Briones, Chandler, AZ (US)

(73) Assignee: Freescale Semiconductor, Inc., Austin, TX (US)

( * ) Notice: Subject to any disclaimer, the term of this patent is extended or adjusted under 35 U.S.C. 154(b) by 291 days.

(21) Appl. No.: 13/013,220

(22) Filed: Jan. 25, 2011

(65) Prior Publication Data

US 2012/0187927 A1 Jul. 26, 2012

(51) Int. Cl.
*G05F 1/44* (2006.01)
*G05F 3/26* (2006.01)

(52) U.S. Cl.
USPC ..... 323/280; 323/315

(58) Field of Classification Search
USPC ..... 323/273, 274, 280–284, 312, 315
See application file for complete search history.

(56) References Cited

U.S. PATENT DOCUMENTS

| | | | | |
|---|---|---|---|---|
| 5,465,011 | A * | 11/1995 | Miller et al. | 307/64 |
| 6,373,734 | B1 * | 4/2002 | Martinelli | 363/89 |
| 6,700,360 | B2 * | 3/2004 | Biagi et al. | 323/280 |
| 6,703,815 | B2 * | 3/2004 | Biagi | 323/280 |
| 7,420,351 | B2 * | 9/2008 | Grbovic | 318/772 |
| 7,446,430 | B2 * | 11/2008 | Leung et al. | 307/38 |
| 7,446,515 | B2 * | 11/2008 | Wang | 323/280 |
| 8,169,203 | B1 * | 5/2012 | Vemula | 323/273 |
| 2007/0114962 | A1 * | 5/2007 | Grbovic | 318/772 |
| 2009/0013199 | A1 * | 1/2009 | Leung et al. | 713/300 |

* cited by examiner

*Primary Examiner* — Adolf Berhane
(74) *Attorney, Agent, or Firm* — Ingrassia Fisher & Lorenz, P.C.

(57) ABSTRACT

Apparatus for voltage regulation circuits and related operating methods are provided. An exemplary voltage regulation circuit includes a voltage regulation arrangement that provides a regulated output voltage based on an input voltage reference, a phase compensation arrangement coupled to the voltage regulation arrangement and configured to increase a phase margin of the voltage regulation arrangement, and detection circuitry coupled to the phase compensation arrangement. The detection circuitry is configured to disable the phase compensation arrangement in response to detecting an output current that is less than a threshold value.

20 Claims, 3 Drawing Sheets

VOLTAGE REGULATION CIRCUITRY AND RELATED OPERATING METHODS

TECHNICAL FIELD

Embodiments of the subject matter described herein relate generally to electronic circuits, and more particularly, embodiments of the subject matter relate to voltage regulators and related circuit topologies that are capable of accurately regulating voltage across a relatively wide range of load currents.

BACKGROUND

Voltage regulators are commonly used in electronic devices to provide a specific voltage level for other components of the device. For example, a low-dropout voltage regulator may be utilized to provide a stable direct current (DC) supply voltage for an electrical load, such as a processor, a controller, or another integrated circuit. However, with some conventional low-dropout voltage regulator topologies, when the amount of current consumed by the load coupled to the regulated output is reduced, the ability of conventional low-dropout voltage regulators to accurately maintain the desired regulated voltage is reduced.

BRIEF DESCRIPTION OF THE DRAWINGS

A more complete understanding of the subject matter may be derived by referring to the detailed description and claims when considered in conjunction with the following figures, wherein like reference numbers refer to similar elements throughout the figures.

DETAILED DESCRIPTION

The following detailed description is merely illustrative in nature and is not intended to limit the embodiments of the subject matter or the application and uses of such embodiments. As used herein, the word "exemplary" means "serving as an example, instance, or illustration." Any implementation described herein as exemplary is not necessarily to be construed as preferred or advantageous over other implementations. Furthermore, there is no intention to be bound by any expressed or implied theory presented in the preceding technical field, background, or the following detailed description.

Technologies and concepts discussed herein relate to voltage regulation circuitry capable of accurately regulating an output voltage over a wide range of output currents. As described in greater detail below, the voltage regulation circuitry includes a phase compensation zero-pole pair that improves the phase margin of the voltage regulation loop, and thereby, improves the stability of the regulated output voltage. In an exemplary embodiment, the phase compensation zero-pole pair is disabled at low output currents to improve the open loop gain of the voltage regulation loop and compensate for decreased transconductance(s) within the voltage regulation loop at low output currents. In this regard, when the output current is below a threshold value, the phase compensation zero-pole pair is effectively short-circuited. Otherwise, while the output current is above the threshold value, the phase compensation zero-pole pair is enabled to improve the phase margin of the voltage regulation loop.

Figure 1:
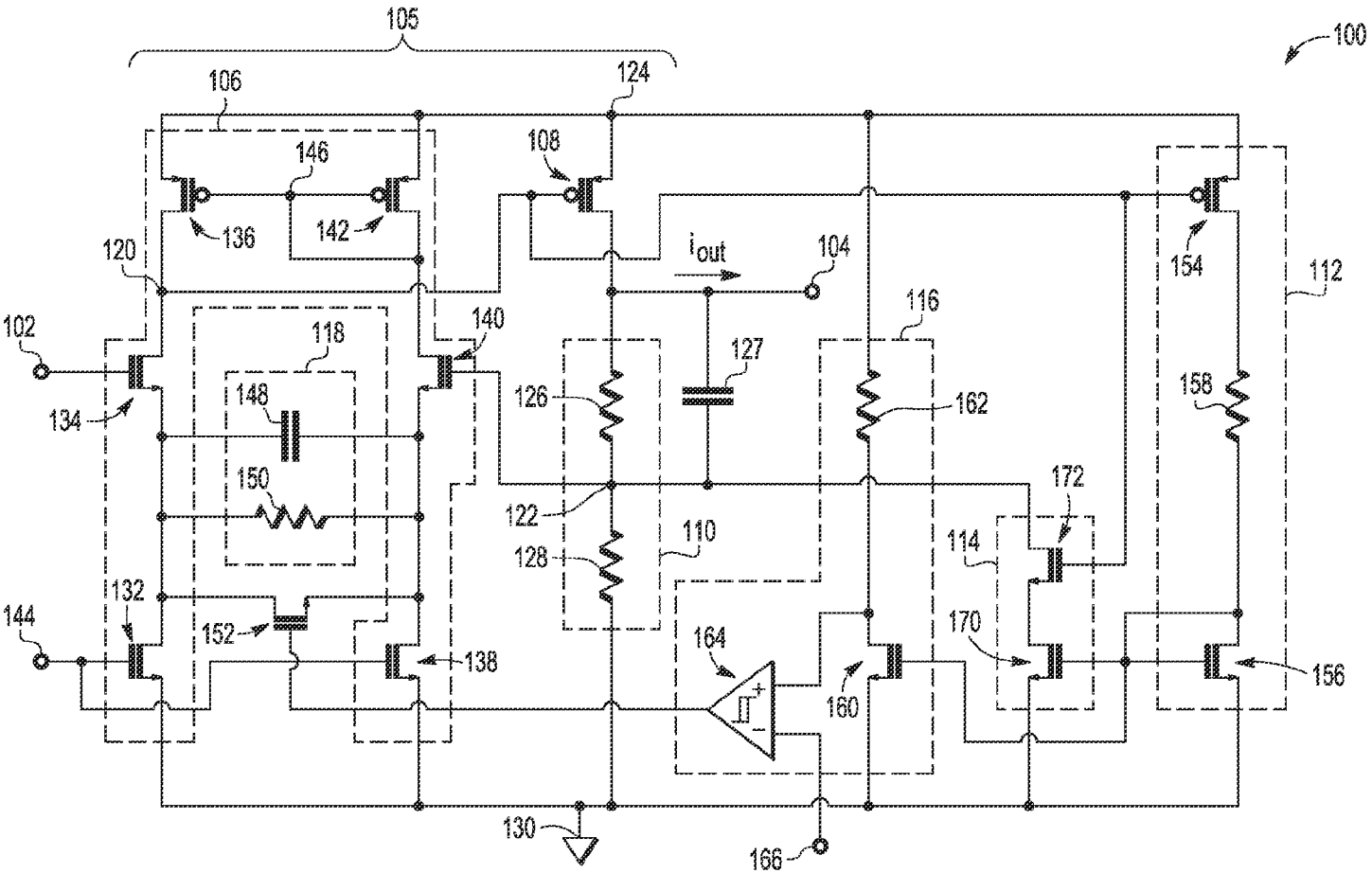
FIG. 1 is a schematic diagram of a voltage regulation circuit in accordance with one embodiment of the invention.

FIG. 1 depicts an exemplary embodiment of voltage regulation circuit 100 configured to produce a regulated output voltage at an output node 104 that is proportionally related to an input voltage reference at an input node 102. The voltage regulation circuit 100 includes, without limitation, a voltage regulation arrangement 105, a current mirror arrangement 112, parasitic compensation circuitry 114, low output current detection circuitry 116, and a phase compensation arrangement 118. In an exemplary embodiment, the voltage regulation circuit 100 is configured as a low-dropout (LDO) regulator capable provide the regulated output voltage at the output node 104 and operating with a relatively small difference between the input voltage reference at the input node 102 and the regulated output voltage at the output node 104. It should be understood that FIG. 1 is a simplified representation of the voltage regulation circuit 100 for purposes of explanation and ease of description, and that practical embodiments may include other devices and components to provide additional functions and features, and/or the voltage regulation circuit 100 may be part of a much larger electrical system, as will be understood. Thus, although FIG. 1 depicts direct electrical connections between circuit elements and/or terminals, alternative embodiments may employ intervening circuit elements and/or components while functioning in a substantially similar manner.

In an exemplary embodiment, the output node 104 of the voltage regulation circuit 100 is coupled to an electrical load, such as a processor, a controller, or another integrated circuit. In some embodiments, the electrical load is capable of being switched between multiple different operating states, wherein the current consumed by the electrical load varies depending on its currently selected operating state. For example, in accordance with one embodiment, the electrical load is capable of being switched between a floating state, where the electrical load consumes substantially no current, and other operating states having greater current consumption. In an exemplary embodiment, the input node 102 is configured to receive a stable and accurate direct current (DC) voltage reference, for example, from a bandgap voltage reference circuit or a Zener diode. The input voltage reference is capable of being adjusted to provide a regulated output voltage at the output node 104 that corresponds to the desired regulated supply voltage for the electrical load coupled to the output node 104.

In an exemplary embodiment, the voltage regulation arrangement 105 is configured as a negative feedback voltage regulation loop that regulates the voltage at the output node 104 to a voltage that is proportionally related to the input voltage reference at the input node 102. The illustrated embodiment of the voltage regulation arrangement 105 includes an amplifier arrangement 106, a pass device 108, and a voltage divider arrangement 110. The amplifier arrangement 106 is configured as an error amplifier that adjusts a voltage that controls the amount of current flowing through the pass device 108 at node 120 based on a difference between a feedback voltage at a node 122 of the voltage divider arrangement 110 and the input voltage reference at the input node 102. In this regard, as described in greater detail below, the amplifier arrangement 106 is configured to increase the control voltage at the control voltage node 120 when the feedback voltage at the feedback voltage node 122 is greater than the input voltage reference at the input node 102, and decrease the control voltage at the control voltage node 120 when the feedback voltage at the feedback voltage node 122 is less than the input voltage reference at the input node 102.

The pass device 108 is coupled between a first node 124 configured to receive a positive supply voltage for the voltage regulation circuit 100 and the output node 104, and the pass device 108 is configured such that the output current ($i_{OUT}$) at the output node 104 flows from the supply voltage node 124 to the output node 104 through the pass device 108. In the illustrated embodiment, the pass device 108 is realized as a P-type transistor (e.g., a P-type metal-oxide-semiconductor field-effect transistor (PMOSFET or PMOS)) having a source terminal connected to the supply voltage node 124, a drain terminal connected to the output node 104, and a gate terminal (or control terminal) connected to the control voltage node 120 of the amplifier arrangement 106. For convenience, but without limitation, the pass device 108 may alternatively be referred to herein as a PMOS transistor. In an exemplary embodiment, the voltage divider arrangement 110 is realized as a first resistive element 126 connected between the output node 104 and the feedback voltage node 122 and a second resistive element 128 connected between the feedback voltage node 122 and a second node 130 configured to receive a ground reference voltage for the voltage regulation circuit 100. As a result, when the control voltage at node 120 increases (e.g., because the feedback voltage is greater than the input voltage reference), the effective resistance of the PMOS transistor 108 increases, which in turn, decreases the current through the PMOS transistor 108 and increases the voltage drop across the PMOS transistor 108 (e.g., the voltage between the drain and source terminals), and thereby, decreases the output voltage at the output node 104 and the feedback voltage at node 122. Conversely, when the control voltage at node 120 decreases (e.g., when the feedback voltage is less than the input voltage reference), the effective resistance of the PMOS transistor 108 decreases, which in turn, decreases the voltage drop across the PMOS transistor 108 and increases the output voltage at the output node 104 and the feedback voltage at node 122. Thus, when the supply voltage at node 124 and the output current ($i_{OUT}$) at the output node 104 (e.g., the current flowing to the load coupled to the output node 104) are constant, the negative feedback loop created by the amplifier arrangement 106, the PMOS transistor 108, and the voltage divider arrangement 110 will force the feedback voltage at node 122 to be equal to the input voltage reference at the input node 102, thereby regulating the output voltage at the output node 104 to a constant value (provided the input voltage reference is held constant). In the illustrated embodiment, the output voltage at the output node 104 is equal to $$V_{REF} \times \frac{R_1 + R_2}{R_2},$$

where $V_{REF}$ is the input voltage reference at node 102, $R_1$ is the resistance of the first resistive element 126, and $R_2$ is the resistance of the second resistive element 128. In practice, the resistances of the resistive elements 126, 128 are relatively small, such that the current flowing through the pass device 108 is substantially equal to the output current ($i_{OUT}$) at the output node 104. In an exemplary embodiment, a capacitive element 127 is connected between the output node 104 and the feedback voltage node 122 to stabilize the voltage difference between the output node 104 and the feedback voltage node 122.

As illustrated in FIG. 1, in an exemplary embodiment, the amplifier arrangement 106 includes an input transistor stack comprising transistors 132, 134, 136 and a feedback transistor stack comprising transistors 138, 140, 142. As used herein, "transistor stack," "stacking transistors," "stacked transistors," or equivalents thereof, should be understood to describe the configuration where a terminal of one transistor device is coupled to a terminal of another transistor device, such that the current passes through the transistor devices in series (e.g., the same current through each transistor device). The input transistor stack includes a first N-type transistor 132 (e.g., an N-type metal-oxide-semiconductor field-effect transistor (NMOSFET or NMOS)) having a source terminal connected to the ground voltage node 130 and a drain terminal coupled to a source terminal of a second N-type transistor 134. The gate terminal of the first transistor 132 is connected to a node 144 configured to receive a bias voltage that biases on the first transistor 132 in the saturation region and controls the amount of current that flows through transistors 132, 134. The drain terminal of the second transistor 134 is connected to a drain terminal of a P-type transistor 136 at the control voltage node 120, and the source terminal of the P-type transistor 136 is connected to the supply voltage node 124. The feedback transistor stack includes an N-type transistor 138 having a source terminal connected to the ground voltage node 130 and a drain terminal coupled to a source terminal of another N-type transistor 140. The gate terminal of transistor 138 is coupled to the gate terminal of transistor 132 at the bias voltage node 144, such that transistor 138 is biased on in the saturation region and mirrors the current through transistor 132. The drain terminal of transistor 140 is connected to a drain terminal of a P-type transistor 142, and the source terminal of the P-type transistor 142 is connected to the supply voltage node 124.

In an exemplary embodiment, the gate terminals of the P-type transistors 136, 142 are connected at a node 146 that is connected to the drain terminal of transistor 140. The gate terminal of transistor 140 is connected to the feedback voltage node 122, such that the feedback voltage at the feedback voltage node 122 influences the voltage at the drain terminal of transistor 140 (e.g., by influencing the effective resistance of transistor 140), which in turn, influences the voltage at the gate terminals of transistors 136, 142. The gate terminal of transistor 134 is connected to the input voltage reference node 102, such that the input voltage reference at the input voltage reference node 102 influences the voltage at the drain terminal of transistor 134, and thereby, influences the voltage at the drain terminal of transistor 136. Thus, when the feedback voltage at the feedback voltage node 122 is greater than the input voltage reference at the input voltage reference node 102, the voltage at the source terminal of transistor 140 increases, which, in turn, causes the voltage at the source terminal of transistor 134 to increase and thereby decreases the gate-to-source voltage of transistor 134. The decrease in the gate-to-source voltage of transistor 134 causes the current through transistors 134, 136 to decrease, which in turn, causes the voltage at node 120 to increase, thereby increasing the channel resistance of pass device 108 and decreasing the voltage at the output node 104 until the feedback voltage at the feedback voltage node 122 is substantially equal to the input voltage reference at the input voltage reference node 102. Similarly, when the voltage at the feedback voltage node 122 is less than the input voltage reference, the voltage at node 120 decreases, thereby decreasing the channel resistance of the pass device 108 and increasing the voltage at the output node 104 until the feedback voltage at the feedback voltage node 122 is substantially equal to the input voltage reference at the input voltage reference node 102.

As illustrated in FIG. 1, in an exemplary embodiment, the phase compensation arrangement 118 includes a capacitive element 148 connected between the source terminals of transistors 134, 140 (or the drain terminals of transistors 132, 138), a resistive element 150 connected between the source terminals of transistors 134, 140 electrically parallel to the capacitive element 148, and a switching element 152 connected between the source terminals of transistors 134, 140 electrically parallel to the capacitive element 148 and the resistive element 150. In this regard, when the switching element 152 is activated or otherwise turned on, the capacitive element 148 and the resistive element 150 are effectively short-circuited and the source terminals of transistors 134, 140 (or the drain terminals of transistors 132, 138) are effectively connected to one another. In the illustrated embodiment, the switching element 152 is realized as an N-type transistor having its drain terminal coupled to the source terminal of transistor 134 (or the drain terminal of transistor 132) and its source terminal coupled to the source terminal of transistor 140 (or the drain terminal of transistor 138). For convenience, but without limitation, the switching element 152 is alternatively referred to herein as a transistor.

In an exemplary embodiment, the resistance of the resistive element 150 and the capacitance of the capacitive element 148 are chosen to optimize the phase margin at the unity gain frequency of the amplifier arrangement 106 by introducing an additional zero and pole into the transfer function for the amplifier arrangement 106. As described in greater detail below, the gate terminal of transistor 152 is coupled to the low output current detection circuitry 116, and the low output current detection circuitry 116 is configured to turn on or otherwise activate the transistor 152 and short circuit the capacitive element 148 and the resistive element 150 in response to detecting that the output current at the output node 104 is less than a threshold value. In this manner, the low output current detection circuitry 116 disables the phase compensation arrangement 118 to increase the open loop gain of the amplifier arrangement 106, and thereby improve the ability of the amplifier arrangement 106 to regulate the output voltage at the output node 104 when the electrical load coupled to the output node is operated in floating state or low current state. As described in greater detail below, in response to detecting that the output current at the output node 104 is greater than the threshold value, the low output current detection circuitry 116 is configured to turn off or otherwise deactivate the transistor 152 to enable the phase compensation arrangement 118, thereby decreasing the open loop gain and increasing the phase margin for the amplifier arrangement 106.

As illustrated in FIG. 1, the first current mirror arrangement 112 includes a pair of transistors 154, 156 configured to mirror the current through the pass device 108 to obtain a reference current that is proportional to the output current ($i_{OUT}$). In this regard, the first transistor 154 is realized as a P-type transistor having its source terminal coupled to the source terminal of PMOS transistor 108 at the supply voltage node 124, and its gate terminal coupled to the gate terminal of PMOS transistor 108 at the control voltage node 120. In this manner, the current through PMOS transistor 108 is mirrored through PMOS transistor 154. The drain terminal of PMOS transistor 154 is coupled to the drain terminal of N-type transistor 156 via a resistance element 158 configured electrically in series between transistors 154, 156. The resistance of the resistance element 158 is chosen to achieve a voltage at the drain terminal of transistor 156 that is substantially equal to the voltage at the drain terminal of a transistor 160 configured to mirror the reference current through the current mirror arrangement 112 so that the transistors 156, 160 will have the same gate bias and drain bias and the resulting current through transistor 160 more accurately replicates the current through transistor 156 and/or current mirror arrangement 112. The gate terminal of the NMOS transistor 156 is connected to the drain terminal of the NMOS transistor 156, and the source terminal of the NMOS transistor 156 is connected to the ground voltage node 130.

In an exemplary embodiment, the low output current detection circuitry 116 includes a transistor 160 configured to mirror the reference current through the current mirror arrangement 112, that is, the current through transistor 156. In this regard, the transistor 160 is realized as an N-type transistor having its source terminal coupled to the source terminal of transistor 156 at the ground voltage node 130 and its gate terminal connected to the gate terminal of the transistor 156. In this manner, the voltage across the NMOS transistor 160 (e.g., the voltage between the drain terminal and the source terminal of the NMOS transistor 160) is proportionally related to the reference current. The drain terminal of the NMOS transistor 160 is coupled to the supply voltage node 124 via a resistive element 162. The low output current detection circuitry 116 includes a comparator 164 having a non-inverting input connected to the drain terminal of transistor 160, an inverting input connected to a node 166 configured to receive a threshold voltage for the comparator 164, and an output connected to the gate terminal of the NMOS transistor 152. As described in greater detail below, the resistance of the resistive element 162 and the threshold voltage at node 166 are chosen such that the comparator 164 generates a logical high voltage at its output when the output current at the output node 104 is less than a lower threshold current value. In an exemplary embodiment, the lower threshold current value represents a value for the output current at the output node 104 that is indicative of the electrical load coupled to the output node 104 being operated in a floating state or otherwise consuming relatively low current. In other embodiments, the lower threshold current value may be chosen to represent a current flowing through the pass device 108 that may reduce transconductance(s) within the voltage regulation arrangement 105 and thereby limit the ability of the voltage regulation arrangement 105 to accurately regulate the output voltage at the output node 104. The logical high voltage at the output of the comparator 164 activates or otherwise turns on transistor 152 to disable the phase compensation arrangement 118 (e.g., by short-circuiting the capacitive element 148 and resistive element 150) and increase the open loop gain of the amplifier arrangement 106. In an exemplary embodiment, the comparator 164 is realized as a hysteresis comparator, such that the comparator 164 does not generate a logical low voltage at its output to enable the phase compensation arrangement 118 until detecting that the output current at the output node 104 is greater than an upper threshold current value that is greater than the lower threshold current value, as described in greater detail below.

In the illustrated embodiment, the parasitic compensation circuitry 114 is realized as a second current mirror arrangement that is configured to mirror the reference current through the first current mirror arrangement 112. The parasitic compensation circuitry 114 is coupled to between the feedback voltage node 122 and the ground voltage node 130 and configured to increase the feedback voltage at the feedback voltage node 122 to compensate for parasitic resistances between the output node 104 and the electrical load coupled to the output node 104, as described in greater detail below.

The parasitic compensation circuitry 114 includes a transistor 170 configured to mirror the reference current through the current mirror arrangement 112, that is, the current through transistor 156. In this regard, the transistor 170 is realized as an N-type transistor having its source terminal coupled to the source terminal of transistor 156 at the ground voltage node 130 and its gate terminal connected to the gate terminal of the transistor 156. The drain terminal of the NMOS transistor 170 is connected to the source terminal of a second NMOS transistor 172, and the drain terminal of the second NMOS transistor 172 is connected to the feedback voltage node 122. The gate terminal of the second NMOS transistor 172 is coupled to the gate terminals of transistors 108, 154 at the control voltage node 120.

In an exemplary embodiment, to compensate for voltage drops caused by parasitic resistances between the output node 104 and an electrical load, the size (e.g., the width and/or length) of PMOS transistor 154 is chosen such that a ratio of the size of PMOS transistor 108 to the size of PMOS transistor 154 is equal to n, where n is equal to the ratio of the resistance of the first resistive element 126 (e.g., $R_1$) of the voltage divider arrangement 110 to the parasitic resistances (e.g., $R_p$) between the output node 104 and the electrical load coupled to the output node 104. In this manner, the current flowing through the current mirror arrangement 112 is equal to the output current at the output node 104 divided by n, and thus, the parasitic compensation circuitry 114 increases the current flowing through the pass device 108 (e.g., the current flowing to the feedback voltage node 122) by $i_{OUT}/n$. As a result, the regulated voltage at the output node 104 is increased by the product of the reference current and the resistance of the first resistive element 126 (e.g., $R_1 \times i_{OUT}/n$), which is equal to the voltage drop across parasitic resistances between the output node 104 and a load coupled to the output node 104 by virtue of n being equal to the ratio of the resistance of the first resistive element 126 to the parasitic resistances (e.g., $n=R_1/R_p$). In this regard, in an exemplary embodiment, the size of the PMOS transistor 154 is configurable or otherwise adjustable, thereby allowing the ratio n to be tuned to the desired amount (e.g., $R_1/R_p$).

As described above, the resistance of the resistive element 162 and the threshold voltage at node 166 are chosen such that the comparator 164 generates a logical high voltage at its output in response to detecting that the output current at the output node 104 is less than a lower threshold value indicative of the electrical load coupled to the output node 104 being operated in a floating state. In this regard, the lower threshold current value may be chosen as a value between the minimum expected load current (or output current) for the electrical load when it is operated in a normal operating state and the expected load current (or output current) when the electrical load coupled to the output node 104 is in a floating state. For example, the lower threshold current value ($i_{TH}$) may be chosen by averaging the minimum load current capable of being consumed by the electrical load at the regulated output voltage and the floating state current of the electrical load at the regulated output voltage. As described above, transistor 160 is configured to mirror the reference current through the current mirror arrangement 112, such that the current flowing through resistive element 162 is equal to the reference current (e.g., the output current through the pass device 108 divided by n). In this regard, the threshold voltage at node 166 and the resistance of the resistive element 162 are chosen to satisfy the equation $V_{TH}=V_{DD}-(R_3 \times i_{TH}/n)$, where $V_{TH}$ is the threshold voltage at node 166, $V_{DD}$ is the supply voltage at node 124, $i_{TH}$ is the lower threshold current value, n is the ratio of the size of transistor 108 to the size of transistor 154 (e.g., $R_1/R_p$), and $R_3$ is the resistance of the resistive element 162. As described above, when the voltage at the drain terminal of the transistor 160 rises above the threshold voltage at node 166 (e.g., due to a decrease in current through the transistor 160 in response to a corresponding decrease in the output current at the output node 104), the comparator 164 generates a logical high output voltage to turn on the NMOS transistor 152 and disable the phase compensation arrangement 118. The comparator 164 does not generate a logical low output voltage to turn off the NMOS transistor 152 and enable the phase compensation arrangement 118 until the voltage at the drain terminal of the transistor 160 falls below the threshold voltage at node 166. As set forth above and described in greater detail below, in accordance with one or more embodiments, the comparator 164 is realized as a hysteresis comparator that maintains the logical high voltage output until the voltage at the drain terminal of the NMOS transistor 160 falls below a second threshold voltage that is less than the threshold voltage at node 166. In some embodiments, the hysteresis comparator 164 may be designed so that the second threshold voltage is indicative of the output current at the output node 104 being greater than an upper threshold current value for the current through the pass device 108 that provides sufficient transconductance for the pass device 108 to allow the voltage regulation arrangement 105 to regulate the output voltage at the output node 104 with a desired level of accuracy when the phase compensation arrangement 118 is enabled.

Figure 2:
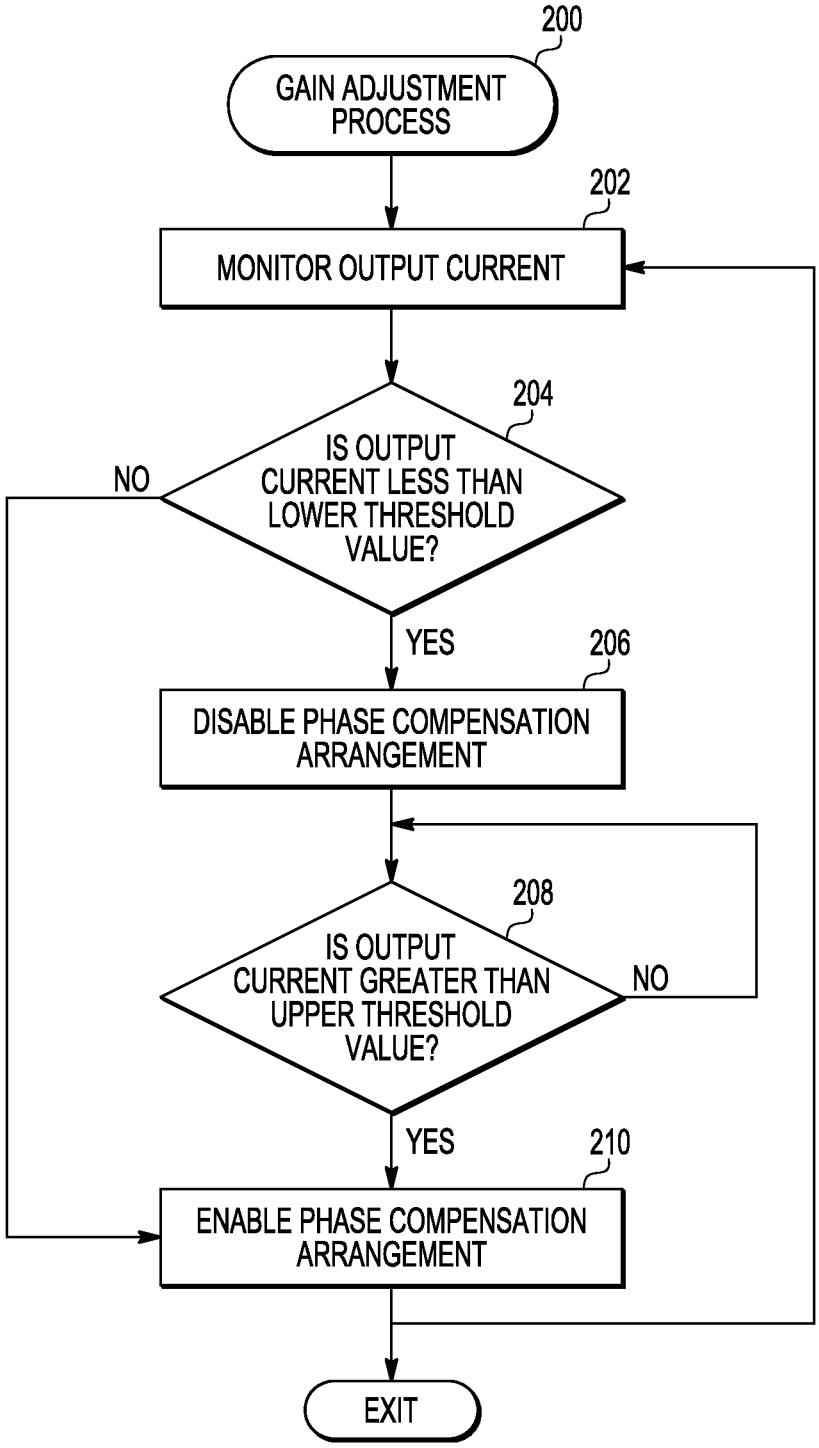
FIG. 2 is a flow diagram of a gain adjustment process suitable for use with the voltage regulation circuit of FIG. 1 in accordance with one embodiment of the invention.

Referring now to FIG. 2, in an exemplary embodiment, the voltage regulation circuit 100 is configured to perform a gain adjustment process 200 and additional tasks, functions, and/or operations as described below. For illustrative purposes, the following description may refer to elements mentioned above in connection with FIG. 1. In practice, the tasks, functions, and operations may be performed by different elements of the described system, such as the amplifier arrangement 106, the current mirror arrangement 112, the low output current detection circuitry 116, and/or the phase compensation arrangement 118. It should be appreciated any number of additional or alternative tasks may be included, and may be incorporated into a more comprehensive procedure or process having additional functionality not described in detail herein.

Referring now to FIG. 2, and with continued reference to FIG. 1, the gain adjustment process 200 may be performed to dynamically adjust the gain and/or phase margin of the amplifier arrangement 106 based on the magnitude of the output current at the output node 104 in order to improve the open loop gain of the amplifier arrangement 106 at relatively low output currents and improve the phase margin of the amplifier arrangement 106 when the output current is sufficient to allow the amplifier arrangement 106 to adequately regulate the output voltage at the output node 104 to a stable and accurate value. In an exemplary embodiment, the gain adjustment process 200 begins by monitoring or otherwise obtaining the output current and comparing the output current to a lower threshold value to detect or otherwise identify when the output current is less than the lower threshold value (tasks 202, 204). As described above, the output current at the output node 104 flowing through the pass device 108 is monitored by mirroring the output current by the current mirror arrangement 112 to obtain a reference current that is proportional to the output current. The transistor 160 of the low output current detection circuitry 116 mirrors the reference current through the current mirror arrangement 112, and the comparator 164 monitors resulting voltage across the transistor 160, which is influenced by the magnitude of the reference current flowing through the transistor 160, as described above. The comparator 164 compares the resulting voltage across the transistor 160 to a threshold voltage at node 166 that is indicative of the lower threshold value for the magnitude of the output current at the output node 104. As described above, in an exemplary embodiment, the threshold voltage at node 166 is chosen based on a threshold current value that is indicative of a load coupled to the output node 104 being operated in a floating state, or is otherwise indicative of an output current that may reduce transconductance(s) within the voltage regulation arrangement 105 and limit the ability of the voltage regulation arrangement 105 to regulate the output voltage at the output node 104 with a desired accuracy.

In an exemplary embodiment, the gain adjustment process 200 continues by either disabling the phase compensation for the amplifier arrangement in response to detecting that the output current is below the lower threshold current value, or otherwise enabling the phase compensation arrangement while the output current is above the lower threshold current value (tasks 206, 210). In this regard, in response to detecting that the voltage across the transistor 160 is greater than the threshold voltage at node 166, the comparator 164 generates a logical high output voltage to activate or otherwise turn on the switching element 152 and thereby disable the phase compensation arrangement 118 by effectively short-circuiting capacitive element 148 and resistive element 150. As set forth above, when the phase compensation arrangement 118 is disabled, the open loop gain of the amplifier arrangement 106 is increased, thereby compensating for the reduction in the transconductance of the pass device 108 caused by the decrease in output current and allowing the voltage regulation arrangement 105 to more accurately regulate the output voltage at the output node 104 when the electrical load coupled to the output node 104 is in a floating state or is otherwise consuming little or no current. Otherwise, while the voltage across the transistor 160 is less than the threshold voltage at node 166, the comparator 164 generates a logical low output voltage to deactivate or otherwise turn off the switching element 152 and thereby enable the phase compensation arrangement 118.

After disabling the phase compensation arrangement, in an exemplary embodiment, the gain adjustment process 200 continues monitoring or otherwise obtaining the output current and detecting or otherwise identifying when the output current is greater than an upper threshold value (task 208). In this regard, the transistor 160 of the low output current detection circuitry 116 continues to mirror or otherwise obtain the reference current through the current mirror arrangement 112, and the comparator 164 continues to monitor the resulting voltage across the transistor 160 while the phase compensation arrangement 118 is disabled. As set forth above, the comparator 164 is preferably realized as a hysteresis comparator, such that the comparator 164 maintains the logical high voltage output (thereby maintaining switching element 152 turned on) until the voltage across the transistor 160 (i.e., the voltage at the drain terminal of the transistor 160) falls below a second threshold voltage that is less than the threshold voltage at node 166. In this regard, the comparator 164 may be designed such that the lower threshold voltage is indicative of the output current at the output node 104 being greater than an upper threshold amount for the output current needed to provide a transconductance for the pass device 108 greater than a threshold amount that allows the voltage regulation arrangement 105 to regulate the output voltage at the output node 104 with a desired accuracy when the phase compensation arrangement 118 enabled. In other embodiments, the comparator 164 may be designed such that the lower threshold voltage is indicative of the load coupled to the output node 104 being operated in a normal operating state where the load consumes current, as opposed to being operated in a floating state.

In response to detecting that the output current is above the upper threshold current value, the gain adjustment process 200 continues by enabling the phase compensation for the amplifier arrangement (task 210). In this regard, in response to detecting that the voltage across the transistor 160 is less than the lower threshold voltage provided by the comparator 164, the comparator 164 generates a logical low output voltage to deactivate or otherwise turn off the switching element 152 and thereby enable the phase compensation arrangement 118. When the phase compensation arrangement 118 is enabled, the open loop gain of the amplifier arrangement 106 is reduced and the phase margin of the amplifier arrangement 106 is increased, thereby improving the stability of output voltage at the output node 104. In an exemplary embodiment, the loop defined by tasks 202, 204, 206, 208, 210 repeats throughout operation of the voltage regulation circuit 100, such that the phase compensation arrangement 118 is disabled whenever the load coupled to the output node 104 is operated in a floating state (i.e., when the output current falls below a lower threshold value) and enabled whenever the load coupled to the output node 104 is operated in a normal operating state that consumes current.

Figure 3:
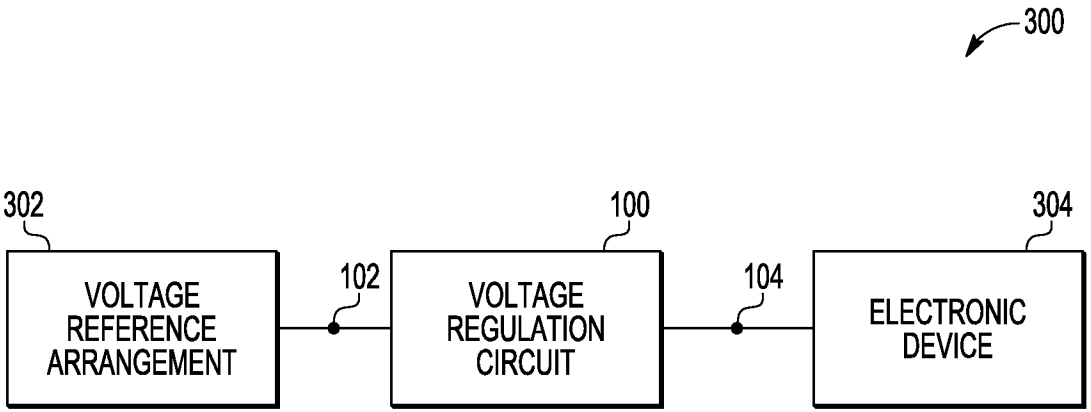
FIG. 3 is a block diagram of an electrical system suitable for use with the voltage regulation circuit of FIG. 1 in accordance with one embodiment of the invention.

Referring now to FIG. 3, and with continued reference to FIGS. 1-2, in an exemplary embodiment, the voltage regulation circuit 100 of FIG. 1 may be utilized in an electrical system 300 to provide a regulated voltage to an electronic device 304, such as an integrated circuit, a processor, a microprocessor, a controller, a microcontroller, a digital signal processor, a sensor, an amplifier, a transceiver, or another suitable electronic component. It should be understood that FIG. 3 is a simplified representation of the electrical system 300 for purposes of explanation and ease of description, and that practical embodiments may include other devices and components to provide additional functions and features, and/or the electrical system 300 may be part of a much larger electrical system, as will be understood. Thus, it should be appreciated that the subject matter is not intended to be limited to any particular electronic device 304.

In an exemplary embodiment, the electrical system 300 includes a voltage reference arrangement 302 configured to provide a stable and accurate DC input voltage reference to the input node 102 of the voltage regulation circuit 100, as described above. The voltage reference arrangement 302 is configured to allow the input voltage reference to be adjusted such that the voltage regulation circuit 100 produces a regulated voltage at the output node 104 that corresponds to the desired regulated supply voltage for the electronic device 304. In an exemplary embodiment, the electronic device 304 includes an input configured to receive a regulated supply voltage that is coupled to the output node 104 of the voltage regulation circuit 100 to receive the regulated supply voltage from the voltage regulation circuit 100. In this manner, the voltage regulation circuit 100 provides the regulated supply voltage for the electronic device 304. As described above, when the electronic device 304 operates in a floating state or otherwise consumes substantially zero current, the low output current detection circuitry 116 disables the phase compensation arrangement 118 to increase the open loop gain of the amplifier arrangement 106, and thereby improve the ability of the voltage regulation circuit 100 to regulate the supply voltage provided to the electronic device 304.

For the sake of brevity, conventional techniques related to voltage regulators, linear regulators, low-dropout regulators, analog circuit design, field-effect transistors (FETs), and other functional aspects of the systems (and the individual operating components of the systems) may not be described in detail herein. Furthermore, the connecting lines shown in the various figures contained herein are intended to represent exemplary functional relationships and/or physical couplings between the various elements. It should be noted that many alternative or additional functional relationships or physical connections may be present in an embodiment of the subject matter. In addition, certain terminology may also be used herein for the purpose of reference only, and thus are not intended to be limiting, and the terms "first", "second" and other such numerical terms referring to structures do not imply a sequence or order unless clearly indicated by the context.

As used herein, a "node" means any internal or external reference point, connection point, junction, signal line, conductive element, or the like, at which a given signal, logic level, voltage, data pattern, current, or quantity is present. Furthermore, two or more nodes may be realized by one physical element (and two or more signals can be multiplexed, modulated, or otherwise distinguished even though received or output at a common node).

The foregoing description refers to elements or nodes or features being "connected" or "coupled" together. As used herein, unless expressly stated otherwise, "connected" means that one element is directly joined to (or directly communicates with) another element, and not necessarily mechanically. Likewise, unless expressly stated otherwise, "coupled" means that one element is directly or indirectly joined to (or directly or indirectly communicates with) another element, and not necessarily mechanically. Thus, although the schematic shown in the figures depict one exemplary arrangement of elements, additional intervening elements, devices, features, or components may be present in an embodiment of the depicted subject matter.

In conclusion, systems, devices, and methods configured in accordance with example embodiments of the invention relate to:

In one exemplary embodiment, an apparatus for a voltage regulation circuit is provided. The voltage regulation circuit includes a voltage regulation arrangement configured to provide a regulated output voltage at an output node based on an input voltage reference at an input node, a phase compensation arrangement coupled to the voltage regulation arrangement, and detection circuitry coupled to the phase compensation arrangement. The phase compensation arrangement is configured to increase a phase margin of the voltage regulation arrangement, and the detection circuitry is configured to disable the phase compensation arrangement in response to detecting an output current at the output node that is less than a threshold value. In accordance with one embodiment, the voltage regulation arrangement includes a first transistor coupled between the output node and a first node and detection circuitry is configured to disable the phase compensation arrangement in a manner that is influenced by the current flowing from the first node to the output node through the first transistor. In another embodiment, the voltage regulation circuit includes a first current mirror arrangement coupled to the first transistor, the first current mirror arrangement being configured to mirror the current flowing from the first node to the output node through the first transistor to obtain a reference current flowing through the first current mirror arrangement, wherein the detection circuitry is coupled to the first current mirror arrangement and configured to disable the phase compensation arrangement in response to detecting the reference current is indicative of the output current at the output node being less than the threshold value. In a further embodiment, the detection circuitry includes a second transistor configured to mirror the reference current flowing through the first current mirror arrangement such that a voltage across the second transistor being influenced by the reference current, and a comparator configured to generate a first signal to disable the phase compensation arrangement when the voltage across the second transistor is greater than a threshold voltage indicative of the output current at the output node being less than the threshold value. In yet a further embodiment, the voltage regulation circuit includes a switching element configured electrically parallel to the phase compensation arrangement, wherein the first signal generated by the comparator activates the switching element to disable the phase compensation arrangement. In another embodiment, the comparator is configured to generate a second signal to enable the phase compensation arrangement when the voltage across the second transistor is less than the threshold voltage. In yet another embodiment, the voltage regulation circuit includes a second current mirror arrangement configured to mirror the reference current flowing through the first current mirror arrangement, wherein the second current mirror arrangement is coupled to the voltage regulation arrangement and configured to increase the regulated output voltage in a manner that is influenced by the reference current. In accordance with another embodiment, the voltage regulation arrangement includes a pass device coupled between the output node and a first node, the output current comprising at least a portion of a current flowing through the pass device from the first node to the output node, a voltage divider arrangement coupled between the output node and a second node, the voltage divider arrangement being configured to establish a feedback voltage at a feedback voltage node, and an amplifier arrangement coupled to the input node, the feedback voltage node, and the pass device, wherein the amplifier arrangement is configured to adjust the current flowing through the pass device based on a difference between the feedback voltage and the input voltage reference. In yet another embodiment, the detection circuitry is configured to enable the phase compensation arrangement in response to detecting the output current at the output node is greater than the threshold value. In accordance with yet another embodiment, a system including the voltage regulation circuit further comprises an electronic device coupled to the output node of the voltage regulation circuit to receive the regulated output voltage.

In accordance with another embodiment, an apparatus is provided for a voltage regulation circuit that includes an input node configured to receive an input voltage reference, an output node, a first node, a second node, a first transistor coupled between the first node and the output node, the first transistor being configured to allow an output current at the output node to flow from the first node to the output node through the first transistor, a voltage divider arrangement coupled between the output node and the second node, the voltage divider arrangement being configured to establish a feedback voltage at a feedback voltage node, an amplifier arrangement coupled to the input node, the feedback voltage node, and the first transistor, wherein the amplifier arrangement and the first transistor are cooperatively configured to adjust an output voltage at the output node based on a difference between the feedback voltage and the input voltage reference, a phase compensation arrangement coupled to the amplifier arrangement, and detection circuitry coupled to the phase compensation arrangement, wherein the detection circuitry is configured to disable the phase compensation arrangement in response to detecting the output current is less than a threshold value. In one embodiment, the phase compensation arrangement is configured to optimize a phase margin at a unity gain frequency of the amplifier arrangement. In another embodiment, the voltage regulation circuit further comprises a second transistor configured electrically parallel to the phase compensation arrangement, wherein the detection circuitry is configured to turn on the second transistor in response to detecting the output current is less than the threshold value. In a further embodiment, the voltage regulation circuit includes a first current mirror arrangement configured to mirror the output current through the first transistor to obtain a reference current, wherein the detection circuitry includes a third transistor configured to mirror the reference current through the first current mirror arrangement, a voltage across the third transistor being influenced by the reference current, and a comparator having a first input, a second input, and an output, the first input being configured to receive the voltage across the third transistor, the second input being configured to receive a comparator reference voltage indicative of the output current being less than the threshold value, and the output being coupled to a gate terminal of the second transistor, and the comparator is configured to generate an output signal at the output to turn on the second transistor when the voltage across the third transistor is greater than the comparator reference voltage. In accordance with another embodiment, the first node is configured to receive a supply voltage, the second node is configured to receive a ground voltage, the first transistor includes a source terminal connected to the first node and a drain terminal connected to the output node, and the amplifier arrangement comprises a second transistor having a gate terminal connected to the input node and a drain terminal connected to a gate terminal of the first transistor, a third transistor having a drain terminal connected to the drain terminal of the second transistor and a source terminal connected to the first node, and a fourth transistor having a gate terminal connected to the feedback voltage node and a drain terminal connected to a gate terminal of the third transistor. The phase compensation arrangement comprises a capacitive element connected between a source terminal of the second transistor and a source terminal of the fourth transistor, and a resistive element connected between the source terminal of the second transistor and the source terminal of the fourth transistor. In a further embodiment, the voltage regulation circuit further comprises a fifth transistor having a drain terminal connected to the source terminal of the second transistor and a source terminal connected to the source terminal of the fourth transistor, wherein the detection circuitry is configured to turn on the fifth transistor in response to detecting the output current is less than the threshold value to disable the phase compensation arrangement. In yet a further embodiment, the voltage regulation circuit includes a first current mirror arrangement configured to mirror the output current through the first transistor to obtain a reference current, wherein the detection circuitry includes a sixth transistor having a source terminal connected to the second node and a gate terminal connected to the first current mirror arrangement to mirror the reference current, and a comparator having a non-inverting input connected to a drain terminal of the sixth transistor, an inverting input configured to receive a voltage indicative of the output current being less than the threshold value, and an output connected to a gate terminal of the fifth transistor.

In another exemplary embodiment, a method is provided for operating voltage regulation circuit including a voltage regulation arrangement configured to regulate an output voltage at an output node based on an input voltage reference. The method involves monitoring an output current at the output node, comparing the output current to a threshold value, and in response to detecting the output current is less than the threshold value, disabling a phase compensation arrangement coupled to the voltage regulation arrangement, the phase compensation arrangement being configured to increase a phase margin of the voltage regulation arrangement when enabled. In one embodiment, monitoring the output current comprises mirroring the output current to obtain a reference current, comparing the output current to the threshold value comprises mirroring the reference current with a first transistor and comparing a voltage across the first transistor to a reference voltage indicative of the output current being less than or equal to the threshold value, the voltage across the first transistor being influenced by the reference current, and disabling the phase compensation arrangement comprises disabling the phase compensation arrangement when the voltage across the first transistor is greater than the reference voltage. In another embodiment, disabling the phase compensation arrangement comprises activating a switching element configured electrically parallel to the phase compensation arrangement.

While at least one exemplary embodiment has been presented in the foregoing detailed description, it should be appreciated that a vast number of variations exist. It should also be appreciated that the exemplary embodiment or embodiments described herein are not intended to limit the scope, applicability, or configuration of the claimed subject matter in any way. Rather, the foregoing detailed description will provide those skilled in the art with a convenient road map for implementing the described embodiment or embodiments. It should be understood that various changes can be made in the function and arrangement of elements without departing from the scope defined by the claims, which includes known equivalents and foreseeable equivalents at the time of filing this patent application.

What is claimed is:

1. A voltage regulation circuit comprising:

a voltage regulation arrangement configured to provide an output voltage at an output node based on an input voltage reference at an input node, wherein the voltage regulation arrangement includes an amplifier arrangement configured to regulate the output voltage based on a difference between a feedback voltage and the input voltage;

a phase compensation arrangement coupled to the amplifier arrangement, the phase compensation arrangement being configured to increase a phase margin of the amplifier arrangement; and detection circuitry coupled to the phase compensation arrangement, wherein the detection circuitry is configured to disable the phase compensation arrangement in response to detecting an output current at the output node is less than a threshold value.

2. The voltage regulation circuit of claim 1, wherein:

the voltage regulation arrangement includes a first transistor coupled between the output node and a first node, the first transistor being configured to allow current to flow from the first node to the output node; and the detection circuitry is configured to disable the phase compensation arrangement in a manner that is influenced by the current flowing from the first node to the output node through the first transistor.

3. The voltage regulation circuit of claim 1, wherein:

the voltage regulation arrangement includes:

a pass device coupled between the output node and a first node, the output current comprising at least a portion of a current flowing through the pass device from the first node to the output node; and a voltage divider arrangement coupled between the output node and a second node, the voltage divider arrangement being configured to establish the feedback voltage at a feedback voltage node;

the amplifier arrangement is coupled to the input node, the feedback voltage node, and the pass device; and, the amplifier arrangement is configured to adjust the current flowing through the pass device based on the difference between the feedback voltage and the input voltage reference.

4. The voltage regulation circuit of claim 1, wherein the detection circuitry is configured to enable the phase compensation arrangement in response to detecting the output current at the output node is greater than the threshold value.

5. A system including the voltage regulation circuit of claim 1, further comprising an electronic device coupled to the output node of the voltage regulation circuit to receive the regulated output voltage.

6. A voltage regulation circuit comprising:

a voltage regulation arrangement configured to provide a regulated output voltage at an output node based on an input voltage reference at an input node, the voltage regulation arrangement including a first transistor coupled between the output node and a first node, the first transistor being configured to allow current to flow from the first node to the output node;

a phase compensation arrangement coupled to the voltage regulation arrangement, the phase compensation arrangement being configured to increase a phase margin of the voltage regulation arrangement;

a first current mirror arrangement coupled to the first transistor, the first current mirror arrangement being configured to mirror the current flowing from the first node to the output node through the first transistor to obtain a reference current flowing through the first current mirror arrangement; and detection circuitry coupled to the first current mirror arrangement, wherein the detection circuitry is configured to disable the phase compensation arrangement in response to detecting the reference current is indicative of the output current at the output node being less than the threshold value.

7. The voltage regulation circuit of claim 6, wherein the detection circuitry includes:

a second transistor configured to mirror the reference current flowing through the first current mirror arrangement such that a voltage across the second transistor being influenced by the reference current; and a comparator configured to generate a first signal to disable the phase compensation arrangement when the voltage across the second transistor is greater than a threshold voltage, the threshold voltage being indicative of the output current at the output node being less than the threshold value.

8. The voltage regulation circuit of claim 7, further comprising a switching element configured electrically parallel to the phase compensation arrangement, wherein the first signal generated by the comparator activates the switching element to disable the phase compensation arrangement.

9. The voltage regulation circuit of claim 7, wherein the comparator is configured to generate a second signal to enable the phase compensation arrangement when the voltage across the second transistor is less than the threshold voltage.

10. The voltage regulation circuit of claim 6, further comprising a second current mirror arrangement configured to mirror the reference current flowing through the first current mirror arrangement, wherein the second current mirror arrangement is coupled to the voltage regulation arrangement and configured to increase the regulated output voltage in a manner that is influenced by the reference current.

11. A voltage regulation circuit comprising:

an input node configured to receive an input voltage reference;

an output node;

a first node;

a second node;

a first transistor coupled between the first node and the output node, the first transistor being configured to allow an output current at the output node to flow from the first node to the output node through the first transistor;

a voltage divider arrangement coupled between the output node and the second node, the voltage divider arrangement being configured to establish a feedback voltage at a feedback voltage node;

an amplifier arrangement coupled to the input node, the feedback voltage node, and the first transistor, wherein the amplifier arrangement and the first transistor are cooperatively configured to adjust an output voltage at the output node based on a difference between the feedback voltage and the input voltage reference;

a phase compensation arrangement coupled to the amplifier arrangement;

a second transistor configured electrically parallel to the phase compensation arrangement; and detection circuitry coupled to the second transistor, wherein the detection circuitry is configured to turn on the second transistor to disable the phase compensation arrangement in response to detecting the output current is less than a threshold value.

12. The voltage regulation circuit of claim 11, wherein the phase compensation arrangement is configured to optimize a phase margin at a unity gain frequency of the amplifier arrangement.

13. The voltage regulation circuit of claim 11, further comprising a first current mirror arrangement configured to mirror the output current through the first transistor to obtain a reference current, wherein:

the detection circuitry includes:

a third transistor configured to mirror the reference current through the first current mirror arrangement, a voltage across the third transistor being influenced by the reference current; and a comparator having a first input, a second input, and an output, the first input being configured to receive the voltage across the third transistor, the second input being configured to receive a comparator reference voltage indicative of the output current being less than the threshold value, and the output being coupled to a gate terminal of the second transistor; and the comparator is configured to generate an output signal at the output to turn on the second transistor when the voltage across the third transistor is greater than the comparator reference voltage.

14. The voltage regulation circuit of claim 11, wherein:

the first node is configured to receive a supply voltage;

the second node is configured to receive a ground voltage;

the first transistor includes a source terminal connected to the first node and a drain terminal connected to the output node;

the amplifier arrangement comprises:

a third transistor having a gate terminal connected to the input node and a drain terminal connected to a gate terminal of the first transistor;

a fourth transistor having a drain terminal connected to the drain terminal of the third transistor and a source terminal connected to the first node; and a fifth transistor having a gate terminal connected to the feedback voltage node and a drain terminal connected to a gate terminal of the fourth transistor; and the phase compensation arrangement comprises:

a capacitive element connected between a source terminal of the third transistor and a source terminal of the fifth transistor; and a resistive element connected between the source terminal of the third transistor and the source terminal of the fifth transistor.

15. The voltage regulation circuit of claim 14, further comprising a sixth transistor having a drain terminal connected to the source terminal of the third transistor and a source terminal connected to the source terminal of the fifth transistor, wherein the detection circuitry is configured to turn on the sixth transistor in response to detecting the output current is less than the threshold value to disable the phase compensation arrangement.

16. The voltage regulation circuit of claim 15, further comprising a first current mirror arrangement configured to mirror the output current through the first transistor to obtain a reference current, wherein the detection circuitry includes:

a seventh transistor having a source terminal connected to the second node and a gate terminal connected to the first current mirror arrangement to mirror the reference current; and a comparator having a non-inverting input connected to a drain terminal of the seventh transistor, an inverting input configured to receive a voltage indicative of the output current being less than the threshold value, and an output connected to a gate terminal of the sixth transistor.

17. A method for operating voltage regulation circuitry including an amplifier arrangement configured to regulate an output voltage at an output node based on a difference between a feedback voltage and an input voltage reference, the method comprising:

monitoring an output current at the output node;

comparing the output current to a threshold value; and in response to detecting the output current is less than the threshold value, disabling a phase compensation arrangement coupled to the amplifier arrangement, the phase compensation arrangement being configured to increase a phase margin of the amplifier arrangement when enabled.

18. The method of claim 17, wherein:

monitoring the output current comprises mirroring the output current to obtain a reference current;

comparing the output current to the threshold value comprises:

mirroring the reference current with a first transistor; and comparing a voltage across the first transistor to a reference voltage indicative of the output current being less than or equal to the threshold value, the voltage across the first transistor being influenced by the reference current; and disabling the phase compensation arrangement comprises disabling the phase compensation arrangement when the voltage across the first transistor is greater than the reference voltage.

19. The method of claim 17, wherein disabling the phase compensation arrangement comprises activating a switching element configured electrically parallel to the phase compensation arrangement.

20. A voltage regulation circuit comprising:

an input node configured to receive an input voltage reference;

an output node;

a first node configured to receive a supply voltage;

a second node configured to receive a ground voltage;

a first transistor coupled between the first node and the output node, the first transistor being configured to allow an output current at the output node to flow from the first node to the output node through the first transistor, the first transistor including a source terminal connected to the first node and a drain terminal connected to the output node;

a voltage divider arrangement coupled between the output node and the second node, the voltage divider arrangement being configured to establish a feedback voltage at a feedback voltage node;

an amplifier arrangement coupled to the input node, the feedback voltage node, and the first transistor, wherein the amplifier arrangement and the first transistor are cooperatively configured to adjust an output voltage at the output node based on a difference between the feedback voltage and the input voltage reference, the amplifier arrangement comprising:

a second transistor having a gate terminal connected to the input node and a drain terminal connected to a gate terminal of the first transistor;

a third transistor having a drain terminal connected to the drain terminal of the second transistor and a source terminal connected to the first node; and a fourth transistor having a gate terminal connected to the feedback voltage node and a drain terminal connected to a gate terminal of the third transistor;

a phase compensation arrangement comprising:

a capacitive element connected between a source terminal of the second transistor and a source terminal of the fourth transistor; and a resistive element connected between the source terminal of the second transistor and the source terminal of the fourth transistor; and detection circuitry coupled to the phase compensation arrangement, wherein the detection circuitry is configured to disable the phase compensation arrangement in response to detecting the output current is less than a threshold value.

* * * * *